US011627847B2

(12) United States Patent
Nyankira

(10) Patent No.: US 11,627,847 B2
(45) Date of Patent: Apr. 18, 2023

(54) PORTABLE TOILET WITH CUSHION

(71) Applicant: Easy Drain Care Products LLC, Grand Prairie, TX (US)

(72) Inventor: Ezra Mokua Nyankira, Grand Prairie, TX (US)

( * ) Notice: Subject to any disclaimer, the term of this patent is extended or adjusted under 35 U.S.C. 154(b) by 0 days.

(21) Appl. No.: 17/572,916

(22) Filed: Jan. 11, 2022

(65) Prior Publication Data

US 2022/0218164 A1 Jul. 14, 2022

Related U.S. Application Data

(60) Provisional application No. 63/135,838, filed on Jan. 11, 2021.

(51) Int. Cl.
*A47K 11/04* (2006.01)

(52) U.S. Cl.
CPC ..... *A47K 11/04* (2013.01)

(58) Field of Classification Search
CPC ..... A47K 11/02; A47K 11/04; A47K 11/06
USPC ..... 4/483, 450
See application file for complete search history.

(56) References Cited

U.S. PATENT DOCUMENTS

| | | | | |
|---|---|---|---|---|
| 2,481,427 | A * | 9/1949 | Hunter | A61G 9/003 4/245.3 |
| 3,513,488 | A | 5/1970 | Oring | |
| 5,819,334 | A * | 10/1998 | Maze | A61G 9/003 4/450 |
| 8,185,978 | B2 | 5/2012 | Mosler | |
| 9,801,769 | B2 * | 10/2017 | Terrell | A61G 9/003 |
| 2005/0066432 | A1 * | 3/2005 | Gouldsworthy | A61G 9/003 4/450 |
| 2013/0185862 | A1 * | 7/2013 | Ballen | A61G 9/003 4/450 |

* cited by examiner

*Primary Examiner* — Huyen D Le
(74) *Attorney, Agent, or Firm* — Gutwein Law; Greg N. Geiser

(57) ABSTRACT

A portable toileting device comprising an interior cavity for holding a fluid, the interior cavity defined by a top side, a bottom side, and a sidewall connecting the top side and the bottom side in a cohesive assembly. The top side having a first set of central apertures and a set of second edge apertures including directional valves allowing for the passage of fluid from the top side to the interior cavity. The top side having at least a pair of cushioned members. The bottom side having a gripping surface on an exterior surface. The sidewall includes a translucent viewing window and graduations for viewing and measuring fluid within the interior cavity.

20 Claims, 8 Drawing Sheets

PORTABLE TOILET WITH CUSHION

CROSS-REFERENCE TO RELATED APPLICATION

This patent application claims priority to U.S. Provisional Patent Application No. 63/135,838 filed Jan. 11, 2021, to the above-named inventor, the disclosure of which is considered part of the disclosure of this application and is hereby incorporated by reference in its entirety.

FEDERALLY SPONSORED RESEARCH OR DEVELOPMENT

Not Applicable.

SEQUENCE LISTING, A TABLE, OR A COMPUTER PROGRAM

Not Applicable.

FIELD OF THE INVENTION

This invention relates generally to a portable toileting device configured to collect bodily waste fluids from a user seated on the device. In one aspect, the device of the present disclosure provides a portable toileting cushion and reservoir tank for users who are not ambulatory or suffer from urinary incontinence.

BACKGROUND

For bedridden patients or other individuals unable to utilize traditional toileting facilities, the typical toileting solution is a bedpan. This traditional bedpan is generally comprised of a rigid material, such as a metal that can be sterilized, and is generally shaped to form a cavity for collecting bodily waste. The waste is then emptied from the bedpan, and it is then cleaned and sterilized for additional use.

The traditional bedpan, although useful, is generally unable to meet the needs of the market as it does not provide a comfortable solution capable of placement and resting upon prior to use. Still further, this traditional solution provides a generally open container that is not capable of closure allowing for the storage of waste contents for an extended period of time in a sanitary condition.

U.S. Pat. No. 3,513,488 discloses a bedpan that is disposable to maintain a sterile environment during use and includes inflatable sides. This inflatable structure provides a softened surface that can be described as cushioned. This '488 device further includes a flap member that functions as a type of cover. This '488 device lacks the rigidity of a traditional bedpan, the inflatable sides can be prone to leakage, and the flap does not provide an adequate closure.

U.S. Pat. No. 8,185,978 discloses an improved bedpan. The bedpan of the '978 disclosure is constructed of a plastic material and includes dividers in an attempt to separate solid waste from liquid waste. This allows for an easier way to separate the waste, as often this waste needs to be measured or recorded. In addition to the compartments, the '978 device includes a living hinge that allows for the stacking of a plurality of bedpans and functions as a splash guard. The '978 device lacks sufficient cushioning, does not include any measurement graduations, and does not include a gripping surface on the bottom. Therefore, there exists a need in the marketplace for an improved and portable toileting device.

SUMMARY OF THE INVENTION

The invention of the present disclosure most generally discloses an improved toileting apparatus that is specifically configured for portable use. This provides an unmet need in the market for an improved toileting apparatus that allows users to relieve themselves when they are incapable of self-toileting.

The device generally provides a cushioned apparatus comprised of a housing forming an interior cavity for the collection of waste. The housing having a bottom side, a top side, and sidewalls enclosing the interior cavity and generally containing the contents within the interior cavity. The housing bottom side, top side, and sidewalls are generally sealed together to form a cohesive structure that can be considered leak free. The interior cavity generally forms a reservoir for the collection of waste, in particular, liquid waste, for later disposal.

The device top side includes two distinct areas having a plurality of apertures with each of these distinct areas configured to allow for a single directional pass through of urine for collection in the reservoir. The two distinct areas of apertures placed in positions on the top side and configured for alignment with the anatomical features of a male and female user during use of the device. Accordingly, the first set defining a set of first central apertures and a set of second edge position apertures. Both the first central apertures and the second edge position apertures including one-way valves, wherein fluid is only able to move in a single direction from a top side of the device into the interior cavity.

The one-way valves generally comprised of a resilient and flexible material having a generally conical shape, wherein fluid pressure from an upper side of the one-way valves opens a lower portion of the one-way valves for flow of fluid into the interior cavity.

The second edge position apertures including a splash guard. The splash guard hingedly received on the top side adjacent to the second edge position apertures and movable from an open position to a closed position. The open position generally allowing access to the second edge position apertures when needed and the closed position generally blocking the second edge position apertures when access is not needed. In the open position, the splash guard is generally orientated perpendicular and upward opposite the top side to help direct bodily fluids/urine into the apertures and prevent splashing.

The top side including at least a pair of cushioned members generally positioned exterior the first central apertures and the set of second edge position apertures. The cushioned members providing a padded area for comfort during use of the device. In the preferred embodiment, the at least a pair of cushioned members are comprised of cushioned and resilient material, such as, but not limited to, foam and include a covering comprised of a vinyl or vinyl like material for easy cleaning and sanitation.

The sidewalls of the device including a generally translucent viewing window and graduations to indicate the volume of the contents within the interior cavity. The translucent viewing window and graduations extending a height of the sidewalls between the bottom side and the top side. This window and graduations are useful for determining an amount of fluid within the interior cavity for reporting or documenting purposes related to the care or health of a user of the device.

The sidewalls further including a drain plug. The drain plug is generally a sealed aperture between the interior space and an exterior of the device sidewalls and configured for removal to allow for the emptying or draining of the interior contents for proper disposal. In a preferred embodiment of the present disclosure, this drain plug includes a threaded cap and a gasketing member(s) to ensure that the contents of the interior do not leak during use of the device.

The sidewalls further including a securing means configured to allow the device to be secured to a structure, such as, but not limited to a chair. Preferably this securing means is a looped fastener or strap member that is affixed to the sidewalls at a rear portion of the device and adjustable to accommodate various sizes and structures for attachment. In the preferred embodiment, this securing means is shown as a pair of adjustable strap members comprised of hook and loop style fasteners to enable a quick, secure, and adjustable fastening.

The sidewalls additionally including a handle. The handle generally positioned along a side portion of the device and configured to provide a grasping or grabbing point for manipulation and carrying of the device.

The bottom side of the device is configured for placement on a surface and is generally the main contact point of the device on this surface during use. Accordingly, this bottom side includes a griping surface generally being a non-slip or non-skid material that increases the friction between the device and surface the device is placed upon. The gripping surface preferably utilizes rubber, rubber-like, silicone, or silicone-like raised nodes for gripping properties, durability, and an ability to be easily cleaned and sanitized.

In an alternate embodiment of the device, the device can be constructed in two distinct sections with a lid portion and a reservoir portion. Accordingly, the lid portion can be received on the reservoir portion in a press fit or a snap fit assembly. The device shape and configuration aids in proper alignment of this assembly and enables fluid to transfer through the lid portion to the reservoir portion. In this configuration, the device one-way valves are placed within the lid portion. This configuration further allows for additional cleaning and sanitation as the lid portion and reservoir portion can be easily separated and cleaned.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
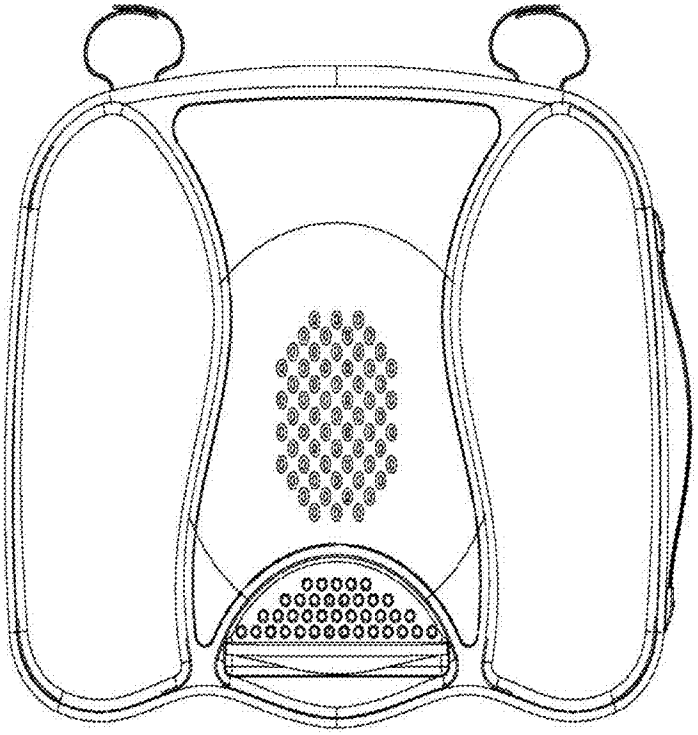
FIG. 1 shows the top of the portable toilet device, according to the present disclosure.
Figure 2:
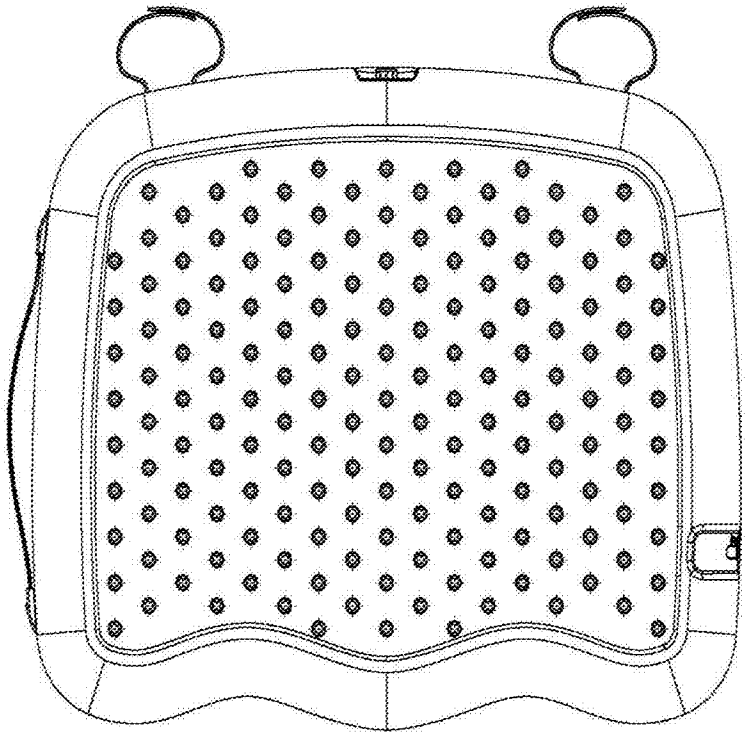
FIG. 2 shows the bottom of the device, according to the present disclosure.
Figure 3:
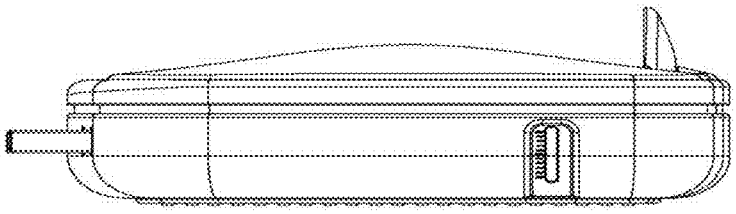
FIG. 3 shows the right side of the device, according to the present disclosure.
Figure 4:
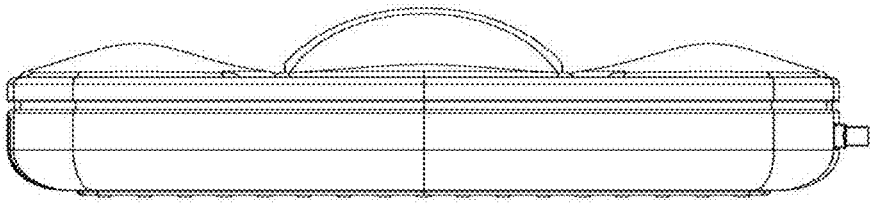
FIG. 4 shows the front of the device, according to the present disclosure.
Figure 5:
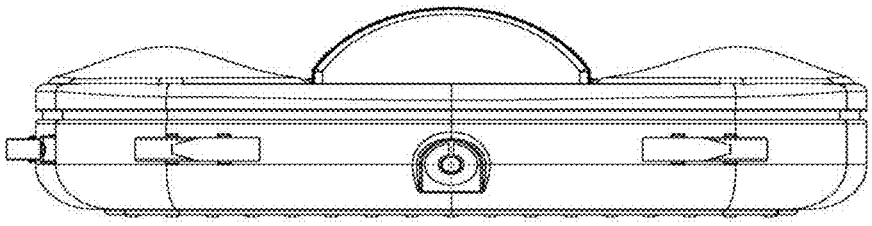
FIG. 5 shows the back of the device, according to the present disclosure.
Figure 6:
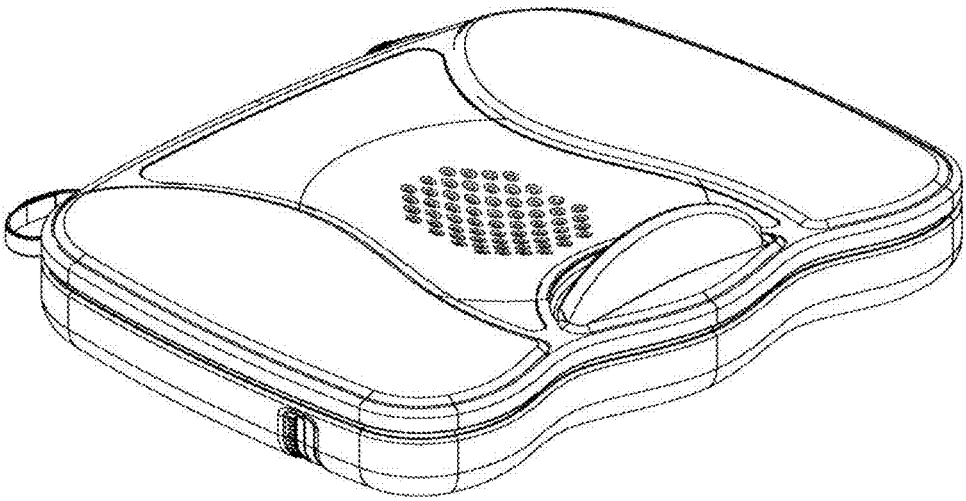
FIG. 6 shows an isometric view of the top side of the device, according to the present disclosure.
Figure 7:
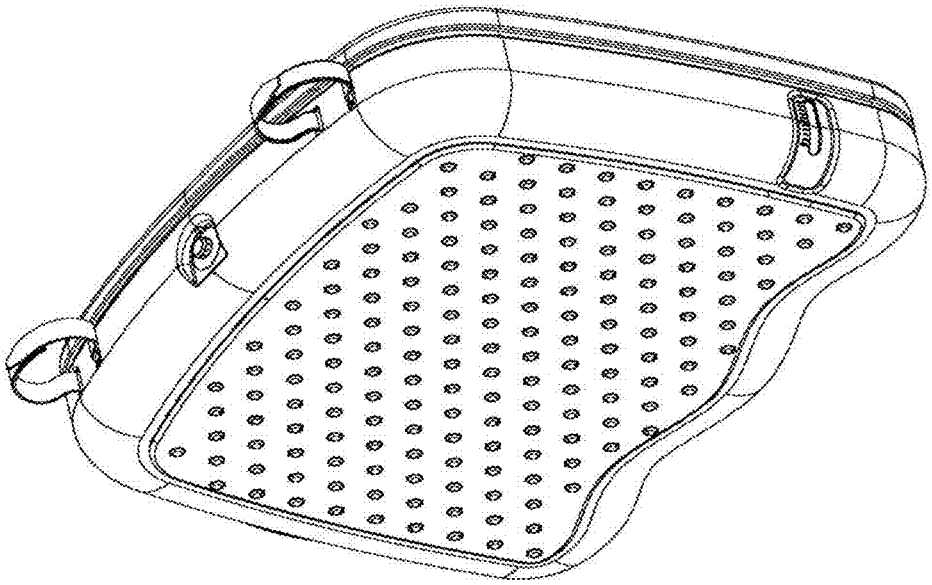
FIG. 7 shows an isometric view of the bottom of the device, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members, or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention is most generally configured as a portable toileting device having a cushioned seating surface.

Referring to the figures, FIG. 1 to FIG. 8 shows a portable toilet with cushion according to the present disclosure and generally referred to herein as the device 10. The device 10 comprises a housing 100 comprised of a top side 101, a bottom side 102, and a plurality of connecting sidewalls 103 defining an interior cavity 104 functioning as a reservoir for the collection of bodily fluids during toileting. The device top side 101 includes two distinct areas having a plurality of apertures 110, 111 with each of these distinct areas configured to allow for a single directional pass through of urine for collection in the reservoir. The two distinct areas of apertures placed in positions on the top side 101 and configured for alignment with the anatomical features of a male and female user during use of the device 10. Accordingly, the first set defining a set of first central apertures 110 and a set of second edge position apertures 111. Both the first central apertures 110 and the second edge position apertures 111 including one-way valves 113, wherein fluid is only able to move in a single direction from a top side of the device into the interior cavity 104.

The one-way valves 113 generally comprised of a resilient and flexible material having a generally conical shape, wherein fluid pressure from an upper side of the one-way valves 113 opens a lower portion of the one-way valves 113 for flow of fluid into the interior cavity 104.

The second edge position apertures 111 including a splash guard 1111. The splash guard 1111 hingedly received on the top side 101 adjacent to the second edge position apertures 111 and movable from an open position to a closed position. The open position generally allowing access to the second edge position apertures 111 when needed and the closed position generally blocking the second edge position apertures 111 when access is not needed. In the open position, the splash guard 1111 is generally orientated perpendicular and upward opposite the top side 101 to help direct bodily fluids/urine into the apertures 111 and prevent splashing.

The top side 101 including at least a pair of cushioned members 112 generally positioned exterior the first central apertures 110 and the set of second edge position apertures 111. The cushioned members 112 providing a padded area for comfort during use of the device 10. In the preferred embodiment, the at least a pair of cushioned members 112 are comprised of cushioned and resilient material, such as, but not limited to, foam and include a covering comprised of a vinyl or vinyl like material for easy cleaning and sanitation.

The sidewalls 103 of the device 10 including a generally translucent viewing window 130 and graduations 131 to indicate the volume of the contents within the interior cavity 104. The translucent viewing window 130 and graduations 131 extending a height of the sidewalls 103 between the bottom side 102 and the top side 101. This window 130 and graduations 131 are useful for determining an amount of fluid within the interior cavity 104 for reporting or documenting purposes related to the care or health of a user of the device 10.

The sidewalls 103 further including a drain plug 132. The drain plug 132 is generally a sealed aperture between the interior space 104 and an exterior of the device 10 sidewalls 103 and configured for removal to allow for the emptying or draining of the interior contents for proper disposal. In a preferred embodiment of the present disclosure, this drain plug 132 includes a threaded cap and gasketing members to ensure that the contents of the interior 104 do not leak during use of the device 10.

The sidewalls 103 further including a securing means 133 configured to allow the device to be secured to a structure, such as, but not limited to a chair. Preferably this securing means 133 is a looped fastener or strap member that is affixed to the sidewalls 103 at a rear portion of the and adjustable to accommodate various sizes and structures for attachment. In the preferred embodiment, this securing means 133 is shown as a pair of adjustable strap members comprised of hook and loop style fasteners to enable a quick, secure, and adjustable fastening.

The sidewalls 103 additionally including a handle 134. The handle 134 generally positioned along a side portion of the device and configured to provide a grasping or grabbing point for manipulation and carrying of the device 10.

The bottom side 102 of the device 10 is configured for placement on a surface and is generally the main contact point of the device 10 on this surface during use. Accordingly, this bottom side 102 includes a griping surface 120 generally being a non-slip or non-skid material that increases the friction between the device 10 and surface the device 10 is placed upon. The gripping surface 120 preferably utilizes rubber, rubber-like, silicone, or silicone-like raised nodes for gripping properties, durability, and an ability to be easily cleaned and sanitized.

Figure 8:
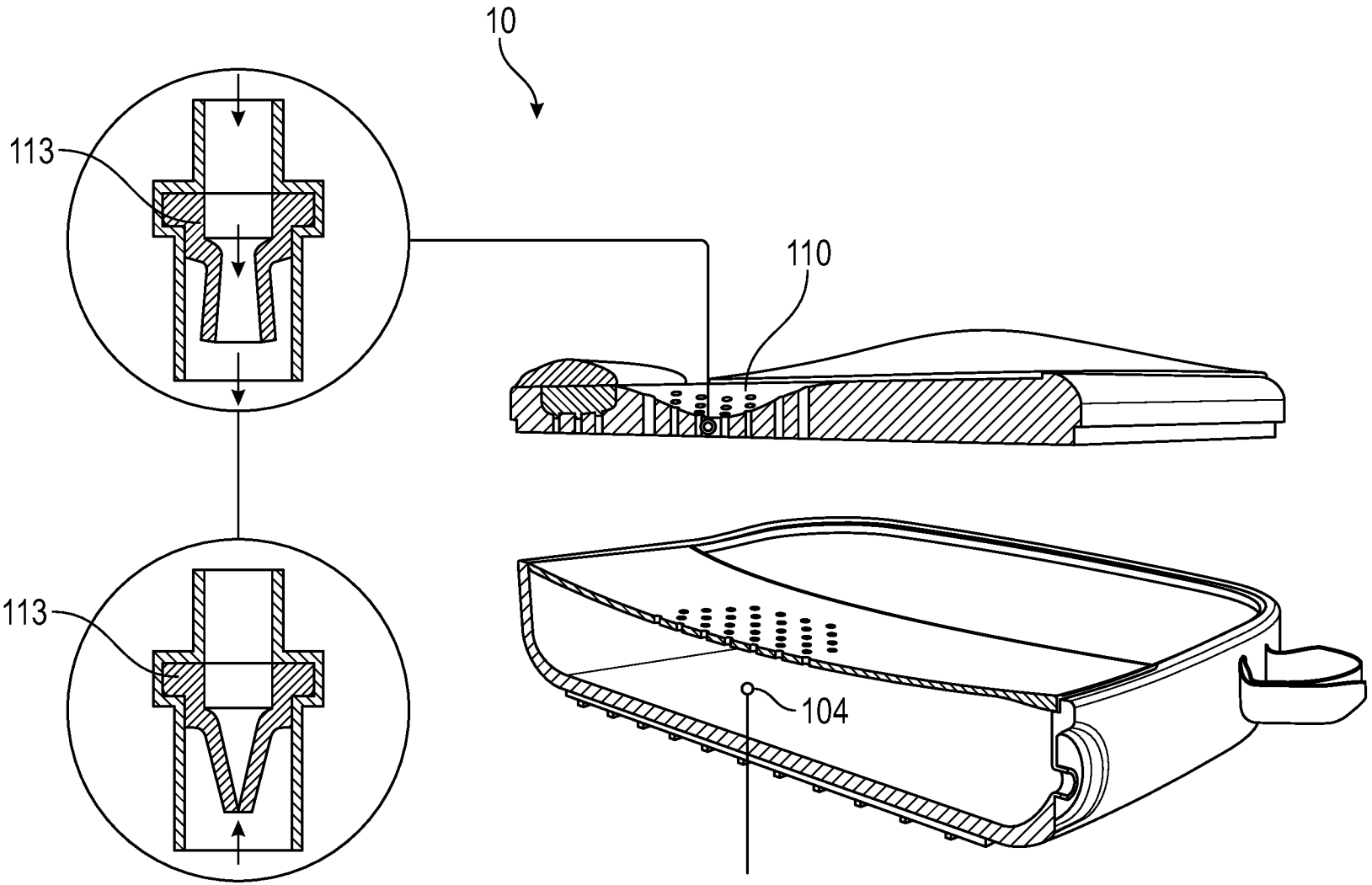
FIG. 8 shows an exploded view of the one-way valves of the device, according to the present disclosure.

As is shown in FIG. 8, in an alternate embodiment of the device 10, the device 10 can be constructed in two distinct sections with a lid portion 200 and a reservoir portion 300.

Accordingly, the lid portion 200 can be received on the reservoir portion 300 in a press fit or a snap fit assembly. The device 10 shape and configuration aids in proper alignment of this assembly and enables fluid to transfer through the lid portion 200 to the reservoir portion 300. In this configuration, the device 10 one-way valves 113 are placed within the lid portion 200. This configuration further allows for additional cleaning and sanitation as the lid portion 200 and reservoir portion can be easily separated and cleaned.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

The invention claimed is:

1. A portable toileting device, the portable toileting device comprising:

an interior cavity for holding a fluid, the interior cavity defined by a top side, a bottom side, and a sidewall connecting the top side and the bottom side in a cohesive assembly;

the top side having a first set of central apertures and a set of second edge apertures, the first set of the central apertures and the set of second edge apertures allowing for the passage of fluid from the top side to the interior cavity, the top side having at least a pair of cushioned members;

the bottom side having a gripping surface on an exterior surface; and the sidewall including a translucent viewing window and graduations, wherein an amount of fluid within the container can be viewed and measured from an exterior of the device.

2. The device as in claim 1, wherein the first set of central apertures and the set of second edge apertures each have a directional valve that allow for the flow of fluid from the top side to the interior cavity.

3. The device as in claim 2, wherein the directional valve is comprised of a resilient material.

4. The device as in claim 1, wherein the top side includes a splash guard, the splash guard hingedly received adjacent to the set of second edge apertures and movable between an open position and a closed position.

5. The device as in claim 1, wherein the sidewalls include a drain plug.

6. The device as in claim 1, wherein the sidewalls include a securing means.

7. The device as in claim 1, wherein the sidewalls include a handle.

8. A portable toileting device, the portable toileting device comprising:

an interior cavity for holding a fluid, the interior cavity defined by a top side, a bottom side, and a sidewall connecting the top side and the bottom side in a cohesive assembly;

the top side comprising:

a first set of central apertures comprising a plurality of distinct apertures, the first set of central apertures centrally positioned along a width and a length of the top side, wherein the first set of central apertures is adapted for alignment with female anatomy;

a set of second edge position apertures comprising a plurality of distinct apertures, the set of second edge apertures positioned centrally along the width and the length of the top side adjacent to an edge of the device, wherein the set of second edge position apertures is adapted for alignment with the male anatomy;

a pair of cushioned members, the cushioned members positioned exterior to each the first set of central apertures and the set of second edge position apertures;

the bottom side having a gripping surface on an exterior surface; and the sidewall including a translucent viewing window and graduations, wherein an amount of fluid within the container can be viewed and measured from an exterior of the device.

9. The device as in claim 8, wherein the first set of central apertures and the set of second edge apertures each have a directional valve that allow for the flow of fluid from the top side to the interior cavity.

10. The device as in claim 9, wherein the directional valve is comprised of a resilient material.

11. The device as in claim 8, wherein the top side includes a splash guard, the splash guard hingedly received adjacent to the set of second edge apertures and movable between an open position and a closed position.

12. The device as in claim 8, wherein the sidewalls include a drain plug.

13. The device as in claim 8, wherein the sidewalls include a securing means.

14. The device as in claim 8, wherein the sidewalls include a handle.

15. The device as in claim 8, wherein the sidewalls include a drain plug.

16. The device as in claim 8, wherein the sidewalls include a securing means.

17. The device as in claim 8, wherein the sidewalls include a handle.

18. A portable cushioned toileting device, the portable cushioned toileting device comprising:

an interior cavity for holding a fluid, the interior cavity defined by a top side, a bottom side, and a sidewall connecting the top side and the bottom side in a cohesive assembly;

the top side comprising:

a first set of central apertures comprising a plurality of distinct apertures, the first set of central apertures centrally positioned along a width and a length of the top side, wherein the first set of central apertures is adapted for alignment with female anatomy;

a set of second edge position apertures comprising a plurality of distinct apertures, the set of second edge apertures positioned centrally along the width and the length of the top side adjacent to an edge of the device, wherein the set of second edge position apertures is adapted for alignment with the male anatomy;

a pair of cushioned members, the cushioned members positioned exterior to each the first set of central apertures and the set of second edge position apertures;

a splash guard, the splash guard hingedly received adjacent to the set of second edge apertures and movable between an open position and a closed position;

the bottom side having a gripping surface on an exterior surface; and the sidewall including a translucent viewing window and graduations, wherein an amount of fluid within the container can be viewed and measured from an exterior of the device.

19. The device as in claim 18, wherein the first set of central apertures and the set of second edge apertures each have a directional valve that allow for the flow of fluid from the top side to the interior cavity.

20. The device as in claim 19, wherein the directional valve is comprised of a resilient material.

* * * * *